US008123085B2

(12) United States Patent
Shih

(10) Patent No.: US 8,123,085 B2
(45) Date of Patent: Feb. 28, 2012

(54) SEALANT GUN WITH UNIVERSAL PUSHING PLATE

(75) Inventor: Po-Jen Shih, Taipei (TW)

(73) Assignee: Napa Corporation, Taipei (TW)

( * ) Notice: Subject to any disclaimer, the term of this patent is extended or adjusted under 35 U.S.C. 154(b) by 408 days.

(21) Appl. No.: 12/535,667

(22) Filed: Aug. 4, 2009

(65) Prior Publication Data

US 2011/0031283 A1 Feb. 10, 2011

(51) Int. Cl.
*B67D 7/60* (2010.01)

(52) U.S. Cl. ..... 222/391; 222/192; 222/326; 222/327; 222/386

(58) Field of Classification Search ..... 222/325–327, 222/191–192, 137, 391, 386; 269/3, 6, 249
See application file for complete search history.

(56) References Cited

U.S. PATENT DOCUMENTS

| | | | | | |
|---|---|---|---|---|---|
| 4,874,155 | A | * | 10/1989 | Goul | 269/6 |
| 5,217,213 | A | * | 6/1993 | Lii | 269/6 |
| 5,263,614 | A | * | 11/1993 | Jacobsen et al. | 222/137 |
| 5,549,225 | A | * | 8/1996 | Lii | 222/192 |
| 5,626,263 | A | * | 5/1997 | Lii | 222/192 |
| 5,743,431 | A | * | 4/1998 | Brattesani | 222/1 |
| 6,640,998 | B1 | * | 11/2003 | Kern | 222/87 |
| D619,863 | S | * | 7/2010 | Shih | D8/14.1 |

* cited by examiner

*Primary Examiner* — Frederick C. Nicolas

(57) ABSTRACT

A sealant gun includes a main body connected to a C-shaped frame, and a pushing rod extends through the main body and a first end of the C-shaped frame. A connection member located between the first end and the second end of the C-shaped frame is connected with a spherical member which is fixed to the distal end of the pushing rod. A pushing plate has a mounting member and a spherical member is rotatably received in the mounting member so that the pushing plate is rotatable relative to the pushing rod and automatically pushes the sealant tube.

4 Claims, 5 Drawing Sheets

SEALANT GUN WITH UNIVERSAL PUSHING PLATE

FIELD OF THE INVENTION

The present invention relates to a sealant gun, and more particularly, to a sealant gun which includes a universal pushing plate so as to automatically provide proper contact to the sealants.

BACKGROUND OF THE INVENTION

A conventional sealant gun generally includes a frame with a pushing rod and a trigger which controls the pushing rod to move forward so that the sealant tube engaged to the frame can be squeezed from its rear end by the pushing rod and the sealant is squeezed out from the front end of the sealant tube. A pushing plate is fixed to the distal end of the pushing rod and contacts the rear end of the sealant tube. The pushing plate usually fixed to the pushing by way of riveting. When a significant resistance is applied to the pushing plate from the sealant tube and the pushing rod is extended forward to a distance, the pushing plate cannot be located at the center of the axis of pushing trace so that the sealant such as caulking or silicone cannot spread on the expected position. The users usually then squeeze the sealant tube by hand or replace a new sealant tube and discard the old one which still has some caulking or silicone remained in the tube. This will be a significant waste and the discarded tubes are difficult to be cleaned and recycled.

The present invention intends to provide a sealant gun which includes a universal spherical member on the distal end of the pushing rod and the pushing plate is rotatably mounted to the spherical member. The pushing plate can automatically contact the sealant tube at the desired position and squeezes the last amount of sealant out from the tube.

SUMMARY OF THE INVENTION

The present invention relates to a sealant gun and comprises a main body which is connected to a C-shaped frame and a pushing rod extends through the main body and a first end of the C-shaped frame. A connection member is connected to the main body and located between the first end and a second end of the C-shaped frame. A distal end of the pushing rod extends through the connection member and is connected to a spherical member. A pushing plate has a front surface and a rear surface, wherein a mounting member is connected to the rear surface of the pushing plate and includes a reception space in which the spherical member is rotatably received. The mounting member includes multiple slits defined through a wall thereof so as to encompass the spherical member.

The primary object of the present invention is to provide a sealant gun which includes a spherical member and a pushing plate is rotatably mounted to the spherical member such that the pushing plate is automatically positioned at a proper angular position to push the rear end of the sealant tube.

Another object of the present invention is to provide a sealant gun wherein the pushing plate can be replaced according the size of the sealant tube.

Yet another object of the present invention is to provide a sealant gun wherein the C-shaped frame has an annular groove defined in the first end thereof such that the sealant tubes of larger size can be well positioned.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
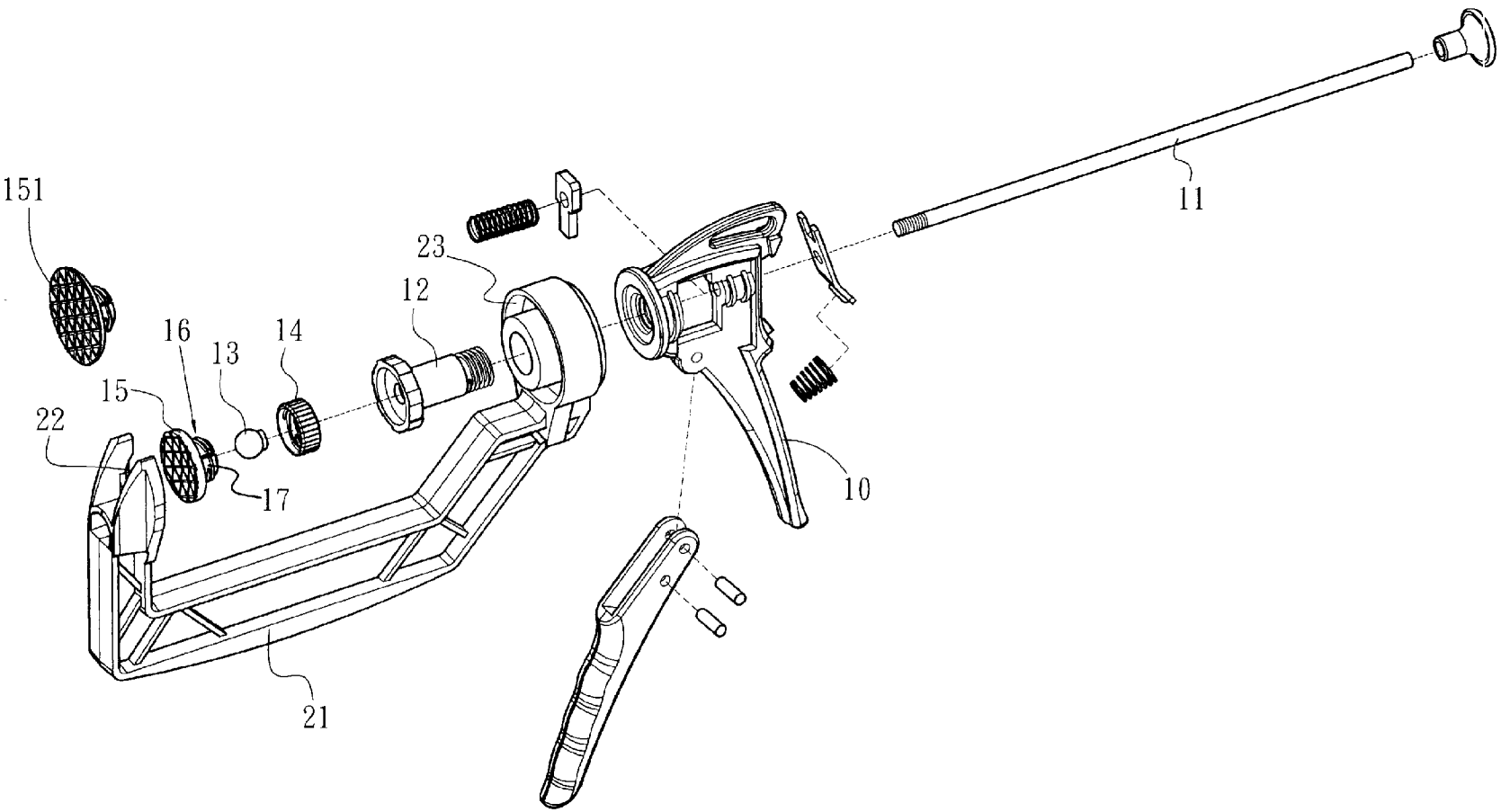
FIG. 1 is an exploded view to show the sealant gun of the present invention.
Figure 2:
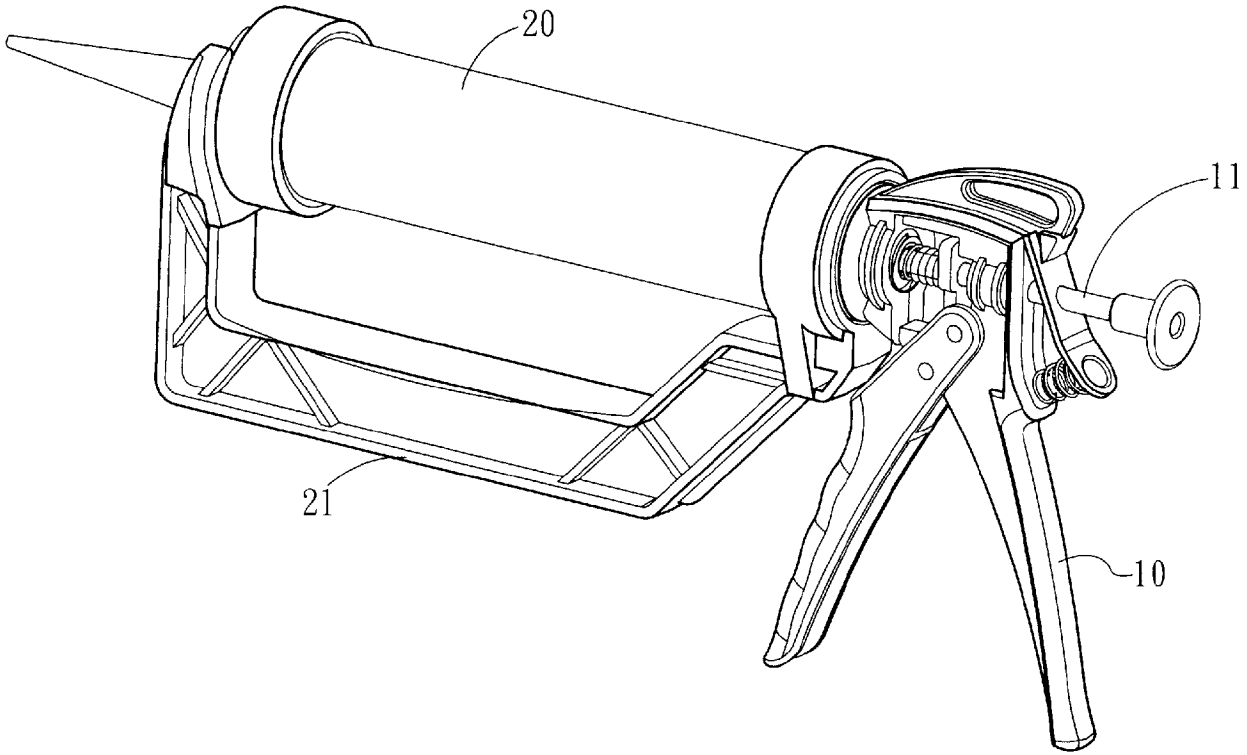
FIG. 2 is a perspective view to show the sealant gun of the present invention with a sealant tube connected thereto.
Figure 3:
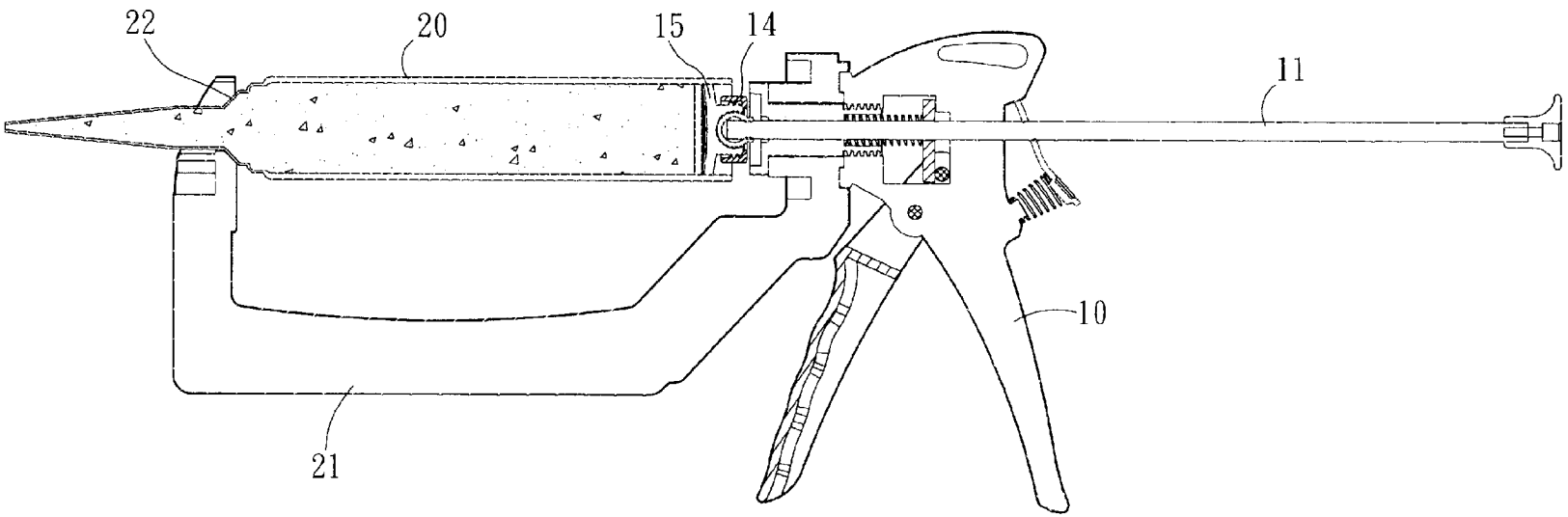
FIG. 3 is a cross sectional view to show the sealant gun of the present invention with a sealant tube connected thereto.

Referring to FIGS. 1 to 3, the sealant gun of the present invention comprises a main body 10 and a C-shaped frame 21 is connected to the main body 10, a trigger is pivotably connected to the main body 10 and a pushing rod 11 extends through the main body 10 and a first end of the C-shaped frame 21. A spring and a driving plate are cooperated with the main body 10 and the pushing rod 11 and will not be described in detailed because they are well known in the art.

A connection member 12 extends through the first end of the C-shaped frame 21 and is connected to the main body 10, and is located between the first end and a second end of the C-shaped frame 21. A distal end of the pushing rod 11 extends through the connection member 12 and is connected to a spherical member 13 which is located in a positioning collar 14.

A pushing plate 15 has a front surface and a rear surface, and a mounting member 16 is connected to the rear surface of the pushing plate 15. The mounting member 16 includes a reception space in which the spherical member 13 is rotatably received. The mounting member 16 includes multiple slits 17 defined through a wall thereof such that the mounting member 16 can be expanded to accommodate the spherical member 13. The front surface of the pushing plate 15 includes serrated patterns which provide proper friction when contacting against the rear end of the sealant tube 20.

A U-shaped recess is defined in the second end of the C-shaped frame 21 and includes an inclined surface 22 which is matched with a shape of the sealant tube 20 as shown in FIG. 3. By this arrangement, the sealant tube 20 is well positioned.

Figure 4:
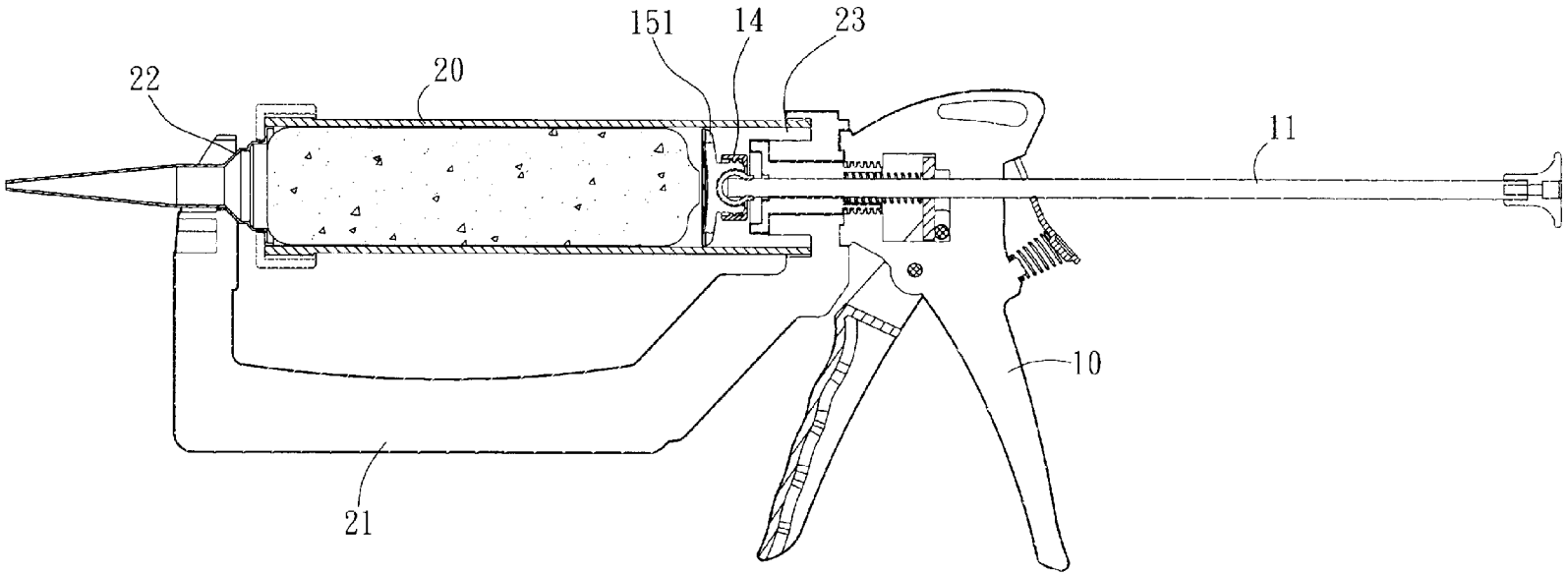
FIG. 4 is a cross sectional view to show a larger sized sealant tube is positioned on the annular engaging groove in the C-shaped frame of the sealant gun of the present invention.

As shown in FIG. 4, the first end of the C-shaped frame 21 includes a tubular portion and an annular engaging groove 23 is defined in the tubular portion so as to receive the rear end of the sealant tube 20.

It is noted that the pushing plate 15 can be replaced with a larger pushing plate 151 as shown in FIG. 1 when needed. The pushing plate 15 is easily removed from the spherical member 13 by pulling the mounting member 16 away from the spherical member 13 and the larger pushing plate 15 can then be mounted to the spherical member 13.

Figure 5:
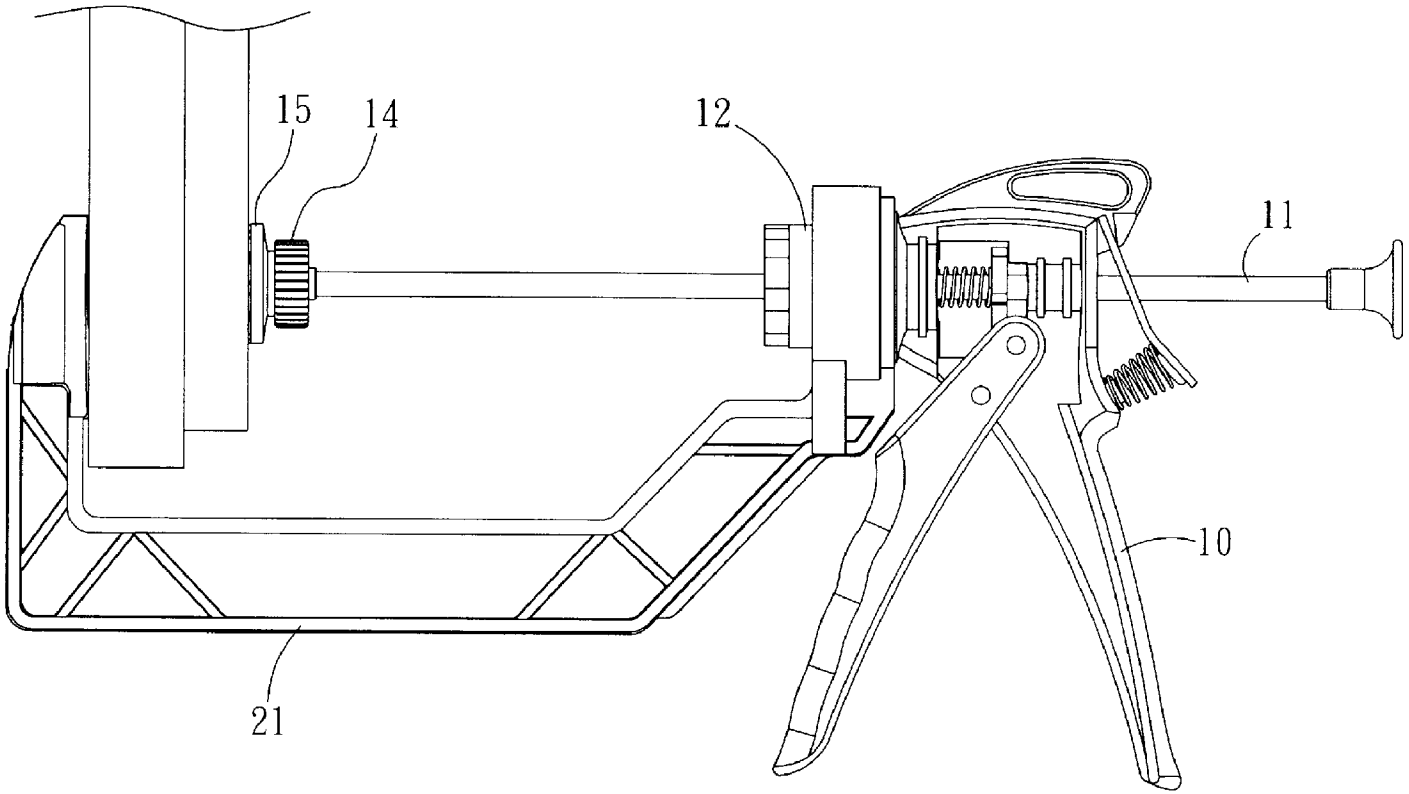
FIG. 5 shows that the sealant gun of the present invention is used as a clamping device.

FIG. 5 shows that the sealant gun of the present invention can be used as a clamping device by contacting the pushing plate 15 against the object on the second end of the C-shaped frame 21.

While we have shown and described the embodiment in accordance with the present invention, it should be clear to those skilled in the art that further embodiments may be made without departing from the scope of the present invention.

What is claimed is:

1. A sealant gun comprising:

a main body and a C-shaped frame connected to the main body, a pushing rod extending through the main body and a first end of the C-shaped frame, a connection member connected to the main body and located between the first end and a second end of the C-shaped frame, a distal end of the pushing rod extending through the connection member and connected to a spherical member which is located in a positioning collar, and a pushing plate having a front surface and a rear surface, a mounting member connected to the rear surface of the pushing plate and including a reception space in which the spherical member is rotatably received, the mounting member including multiple slits defined through a wall thereof so as to encompass the spherical member.

2. The sealant gun as claimed in claim 1, wherein the front surface of the pushing plate includes serrated patterns.

3. The sealant gun as claimed in claim 1, wherein an annular engaging groove is defined in the first end of the C-shaped frame so as to be adapted to receive a rear end of a sealant tube.

4. The sealant gun as claimed in claim 1, wherein a U-shaped recess is defined in the second end of the C-shaped frame and includes an inclined surface which is adapted to be matched with a shape of the sealant tube.

* * * * *